US011925234B2

(12) United States Patent
Garcia et al.

(10) Patent No.: US 11,925,234 B2
(45) Date of Patent: Mar. 12, 2024

(54) ARTICLE OF FOOTWEAR HAVING AN UPPER ASSEMBLY

(71) Applicant: PUMA SE, Herzogenaurach (DE)

(72) Inventors: Jacob Garcia, Woburn, MA (US); Joshua Muller, Boston, MA (US); Jerry C Ni, Marlborough, MA (US)

(73) Assignee: PUMA SE, Herzogenaurach (DE)

( * ) Notice: Subject to any disclaimer, the term of this patent is extended or adjusted under 35 U.S.C. 154(b) by 107 days.

(21) Appl. No.: 16/147,155

(22) Filed: Sep. 28, 2018

(65) Prior Publication Data

US 2020/0100563 A1 Apr. 2, 2020

(51) Int. Cl.

| | |
|---|---|
| ***A43B 13/14*** | (2006.01) |
| ***A43B 1/04*** | (2022.01) |
| ***A43B 13/12*** | (2006.01) |
| ***A43B 13/28*** | (2006.01) |
| ***A43C 1/04*** | (2006.01) |

(52) U.S. Cl.

CPC ..... *A43B 13/141* (2013.01); *A43B 1/04* (2013.01); *A43B 13/122* (2013.01); *A43B 13/28* (2013.01); *A43C 1/04* (2013.01)

(58) Field of Classification Search

CPC ..... A43B 1/04; A43B 23/027; A43B 23/00; A43B 23/0235; A43B 13/141; A43B 13/122; A43B 13/28; A43B 23/024; A43B 23/0265; A43C 1/04

USPC ..... 36/45, 50.1, 55

See application file for complete search history.

(56) References Cited

U.S. PATENT DOCUMENTS

| | | | | |
|---|---|---|---|---|
| 1,952,628 A | | 3/1934 | Macdonald | |
| D236,664 S | | 9/1975 | Moore | |
| D237,425 S | | 11/1975 | Askew | |
| D237,426 S | | 11/1975 | Thornberry | |
| RE34,890 E | * | 4/1995 | Sacre | A43B 7/125 36/55 |

(Continued)

FOREIGN PATENT DOCUMENTS

| | | |
|---|---|---|
| CN | 204048259 U | 12/2014 |
| CN | 105476172 A | 4/2016 |

(Continued)

OTHER PUBLICATIONS

International Search Report and Written Opinion issued in corresponding International Application No. PCT/IB2019/058309, dated Dec. 13, 2019, 16 pages.

(Continued)

*Primary Examiner* — Nathan E Durham
*Assistant Examiner* — Abby M Spatz
(74) *Attorney, Agent, or Firm* — Quarles & Brady LLP

(57) ABSTRACT

An article of footwear includes an upper with an outer layer, an elastic layer, and a lacing system. The outer layer extends through a forefoot region, a midfoot region, and a heel region of the article of footwear and covers, at least partially, a medial side and a lateral side of the article of footwear. The elastic layer extends through the midfoot region and the heel region of the article of footwear and covers, at least partially, an instep region of the article of footwear. The lacing system extends, at least partially, across the instep region, and the outer layer includes a first elasticity and the elastic layer includes a second elasticity at least three times greater than the first elasticity.

20 Claims, 5 Drawing Sheets

(56) References Cited

U.S. PATENT DOCUMENTS 5,678,329 A * 10/1997 Griffin ..... A43B 5/00 36/114
D412,239 S 7/1999 Sorofman
D414,920 S 10/1999 Cahill
D423,199 S 4/2000 Cahill
D446,914 S 8/2001 Cockrell
D460,852 S 7/2002 Daudier
D488,916 S 4/2004 McClaskie
D529,695 S 10/2006 Cockrell
D532,585 S 11/2006 McDonald
D542,017 S 5/2007 Cockrell
D554,839 S 11/2007 Jensen
D569,588 S 5/2008 James
D577,880 S 10/2008 White
D613,041 S 4/2010 Thompson
D613,480 S 4/2010 Lamont
D615,734 S 5/2010 Di Nucci
D634,520 S 3/2011 Choi
D651,387 S 1/2012 Van Zyll De Jong et al.
D709,680 S 7/2014 Herath
D720,920 S 1/2015 Santos
D724,304 S 3/2015 Santos
D729,503 S 5/2015 Carroll et al.
D731,761 S 6/2015 Carroll et al.
D765,362 S 9/2016 Kuerbis
D775,807 S 1/2017 Rauner
D776,410 S 1/2017 Galway et al.
D783,960 S 4/2017 Hatfield
D785,295 S 5/2017 Carroll et al.
D789,053 S 6/2017 Ruark
D792,683 S 7/2017 Carroll et al.
D792,686 S 7/2017 Small
D793,676 S 8/2017 Slimane
D793,677 S 8/2017 Slimane
D793,687 S 8/2017 Cin
D796,160 S 9/2017 Guichot
D796,168 S 9/2017 Shyllon
D796,170 S 9/2017 Raysse
D797,416 S 9/2017 Lee et al.
D797,417 S 9/2017 Lee et al.
D798,555 S 10/2017 Enayah
D799,183 S 10/2017 Weeks
D799,800 S 10/2017 Engel
D799,801 S 10/2017 Da Costa Pereira Machado
D802,266 S 11/2017 Hardman
D808,136 S 1/2018 T.ae butted.stensen et al.
D812,872 S 3/2018 Palmer
D823,580 S 7/2018 Pauk
D828,686 S 9/2018 Hoellmueller et al.
D844,952 S 4/2019 Taylor
D848,129 S 5/2019 Hatfield et al.
D850,766 S 6/2019 Girard et al.
D850,767 S 6/2019 Gallo
D852,475 S 7/2019 Hoellmueller
D852,476 S 7/2019 Hartmann
D852,480 S 7/2019 Kaiserswerth et al.
D853,099 S 7/2019 Parrett
D853,691 S 7/2019 Coonrod et al.
D854,285 S 7/2019 Chang
D855,297 S 8/2019 Motoki
D855,952 S 8/2019 Hardy
D855,953 S 8/2019 Girard et al.
D856,648 S 8/2019 Small
D856,649 S 8/2019 Small
D857,358 S 8/2019 Greenhalgh et al.
D858,051 S 9/2019 Mace
D858,960 S 9/2019 Mace
D858,961 S 9/2019 Mace
D859,796 S 9/2019 McLellan et al.
D862,051 S 10/2019 Goussev et al.
D862,857 S 10/2019 Boudreau et al.
D866,134 S 11/2019 McMillan
D866,137 S 11/2019 Kanata
D866,934 S 11/2019 Zeng
D866,935 S 11/2019 Dao et al.
D867,733 S 11/2019 Kanata
D867,734 S 11/2019 Dieudonne
D868,440 S 12/2019 Dieudonne
D869,132 S 12/2019 deMontgolfier
D869,833 S 12/2019 Hartmann et al.
D870,433 S 12/2019 Hartmann et al.
D871,035 S 12/2019 Amago
D871,729 S 1/2020 Taylor
D873,545 S 1/2020 Hartmann et al.
D874,098 S 2/2020 Hartmann et al.
D874,099 S 2/2020 Hartmann et al.
D876,757 S 3/2020 Hartmann et al.
D877,465 S 3/2020 Hartmann et al.
D883,620 S 5/2020 Gridley
D885,719 S 6/2020 Garcia
2007/0068040 A1 3/2007 Farys
2008/0060221 A1 3/2008 Hottinger
2008/0110048 A1 5/2008 Dua et al.
2008/0110049 A1* 5/2008 Sokolowski ..... A43B 3/0031 36/50.1
2010/0047550 A1 2/2010 Prissok et al.
2012/0023786 A1 2/2012 Dojan
2012/0246973 A1* 10/2012 Dua ..... A43B 23/0275 36/83
2013/0019500 A1* 1/2013 Greene ..... A43B 23/0245 36/50.1
2013/0145653 A1 6/2013 Bradford
2013/0291409 A1 11/2013 Reinhardt et al.
2014/0150292 A1 6/2014 Podhajny et al.
2014/0151918 A1 6/2014 Hartmann
2014/0196311 A1 7/2014 Follet et al.
2014/0310983 A1* 10/2014 Tamm ..... A43B 23/0235 36/83
2015/0059209 A1 3/2015 Dekovic et al.
2015/0075031 A1* 3/2015 Podhajny ..... A43B 1/04 36/45
2016/0302524 A1 10/2016 Smith
2016/0374428 A1 12/2016 Kormann et al.
2017/0105487 A1 4/2017 Klein
2017/0258169 A1 9/2017 Zavala
2017/0341325 A1 11/2017 Le et al.
2018/0042333 A1* 2/2018 Manos-Gully ..... A43B 3/0036
2018/0235307 A1 8/2018 Dekovic et al.
2018/0249787 A1 9/2018 Fuerst, Sr.
2018/0255877 A1* 9/2018 Wilson ..... A43C 5/00
2018/0317594 A1* 11/2018 Brinkman ..... D04B 1/12
2019/0082789 A1 3/2019 Smith et al.

FOREIGN PATENT DOCUMENTS

EP 3153053 A1 4/2017
EP 3308663 A1 4/2018
EP 2109637 B1 7/2018
WO 2013019934 A1 2/2013
WO 2015038344 A1 3/2015

OTHER PUBLICATIONS

Suede Trim DLX Sneakers, Puma.com, [online], [site visited Jan. 3, 2020]. <URL: https://us.puma.com/en/us/pd/suede-trim-dlx-sneakers/371749.html?dwvar _371749_color=01 > (Year: 2020).

Bari Sneakers, Puma.com, [online], [site visited Jan. 3, 2020]. <URL: https:/us.puma.com/en/us/pd/bari-sneakers/369116.html?dwvar_369116_color=11> (Year: 2020).

Puma Smash v2 Max Sneakers, Puma.com, [online], [site visited Jan. 3, 2020]. <URL: https://us.puma.com/en/us/pd/puma-smash-v2-max-sneakers/371135.html?dwvar_371135_color=02> (Year: 2020).

Clyde Court Roses Basketball Shoes, Puma.com, [online], [site visited Jan. 3, 2020]. <URL: https://us.puma.com/en/us/pd/ clyde-court-roses-basketball-shoes/192983.html?dwvar_192983_color=01> (Year: 2020).

Ralph Sampson Demi OG Men's Sneakers, Puma.com, [online], [site visited Jan. 3, 2020]. <URL: https://us.puma.com/en/us/pd/ralph-sampson-demi-og-mens-sneakers/371683.html?dwvar_371683_color=03> (Year: 2020).

(56) References Cited

OTHER PUBLICATIONS

Puma Clyde Court Disrupt Performance Review, YouTube.com, WearTesters, Published on Oct. 10, 2018, [online], [site visited Jan. 3, 2020]. <URL: https://www.youtube.com/watch?v=OPD940y5_ac> (Year: 2018).
Puma Clyde Court Performance Review, SoleCollector.com, by Zac Dubasik, Oct. 29, 2018, [online], [site visited Jan. 3, 2020]. <URL: https://solecollector.com/news/2018/10/puma-clyde-court-disrupt-performance-review/> (Year: 2018).
Ralph Sampson Mid BHM Men's Sneakers, Puma.com, [online], [site visited Feb. 6, 2020]. <URL: https://us.puma.com/en/us/pd/ralph-sampson-mid-bhm-mens-sneakers/374684.html?dwvar_374684_color=01 > (Year: 2020).
Data-Driven, 3-D-printed running shoe midsoles, YouTube.com, MIT Alumni Association, Published on Feb. 15, 2017, [online], [site visited Feb. 6, 2020]. <URL: https://www.youtube.com/watch?v=3Enbo9enidA> (Year: 2017).
International Search Report and Written Opinion issued in corresponding International Application No. PCT/IB2019/058310, dated Nov. 29, 2019, 11 pages.

* cited by examiner

ARTICLE OF FOOTWEAR HAVING AN UPPER ASSEMBLY

CROSS REFERENCE TO RELATED APPLICATIONS

Not applicable

REFERENCE REGARDING FEDERALLY SPONSORED RESEARCH OR DEVELOPMENT

Not applicable

SEQUENCE LISTING

Not applicable

BACKGROUND OF THE INVENTION

1. Field of the Invention

The present invention relates generally to an article of footwear including an upper having an outer layer with a first elasticity and an instep layer with a second elasticity.

2. Description of the Background of the Invention

Many conventional shoes or articles of footwear generally comprise an upper and a sole attached to a lower end of the upper. Conventional shoes further include an internal space or void, created by the upper and sole, that receives a foot during use. The sole is attached to a lower surface of the upper and is positioned between the upper and the ground. As a result, the sole typically provides stability and cushioning to a wearer. In some instances, the sole may include multiple components, such as an outsole, a midsole, and an insole. The outsole may provide traction to a bottom surface of the sole, and the midsole may be attached to an inner surface of the outsole and may provide cushioning and added stability to the sole. For example, a sole may include a particular foam material that increases the stability at desired locations of the sole or a foam material that reduces stress or an impact energy on the foot and/or leg during running, walking, or other use.

The upper generally extends upward from the sole and provides an interior void that encases a foot. In most cases, an upper extends over an instep region and a toe region of a foot, along with extending across a medial and lateral side of a foot. Many articles of footwear may also include a tongue that extends across the instep region to bridge a gap between upper edges of the upper. The tongue may also be provided below a lacing system, which may adjust a tightness of the upper to permit entry and exit of a foot from the internal space or void. In addition, the lacing system may allow a wearer to adjust certain dimensions of the upper, thereby allowing the upper to accommodate feet with varying sizes and shapes.

The upper of many articles of footwear may also include varying materials, which may be altered or chosen based on a particular use of the article of footwear. The upper may also include portions with varying materials specific to a particular area of the upper. For example, added stability may be desirable at the front of the upper or heel regions to provide a high degree of resistance or rigidity. In contrast, other portions of an article of footwear may include a soft woven textile to provide an area with stretch-resistance, flexibility, air-permeability, or moisture-wicking properties.

However, in many cases, articles of footwear having uppers with an increased comfort and fit are desired, along with soles having improved cushioning systems or structural characteristics.

SUMMARY OF THE INVENTION

An article of footwear, as described herein, may have various configurations. The article of footwear may have an upper and a sole structure connected to the upper. The upper may include an outer layer and an elastic layer. The outer layer may extend through a forefoot region, a midfoot region, and a heel region of the article of footwear, and may cover at least partially a medial side and a lateral side of the article of footwear. The elastic layer may extend through the midfoot region and the heel region of the article of footwear, and cover at least partially an instep region of the article of footwear. The article of footwear may also include a lacing system that extends, at least partially, across the instep region of the article of footwear. The outer layer may also include a first elasticity and the elastic layer may include a second elasticity at least three times greater than the first elasticity.

In some embodiments, the outer layer may be a knitted structure, and the outer layer and the elastic layer may be coupled or connected using a seam. The article of footwear may also include an inner layer. The inner layer may be below the outer layer and the elastic layer, and may include a portion that extends from the lateral side of a sole structure to the medial side of a sole structure. Further, the inner layer may be at least partially connected to the elastic layer.

In one aspect, the elastic layer may include an instep layer and a collar layer. The instep layer may extend at least partially across the instep region and the collar layer may extend at least partially from the instep region to the heel region. The upper may also include an intermediate layer below the outer layer. In some embodiments, the outer layer and the intermediate layer may extend at least partially from the sole structure to the elastic layer.

According to another aspect, the article of footwear may also include a lacing system. The lacing system may include at least one lacing strap between the outer layer and the intermediate layer, and may be connected to the sole structure. The lacing strap may also include a loop. The lacing system may further include at least one aperture in the outer layer and a lace, which may be threaded through the loop. In addition, the lacing strap may partially extend from the aperture. In particular embodiments, the lacing system comprises at least four lacing straps on the medial side and at least four straps on the lateral side. The lacing system may also include a first set of the lacing straps and a second set of the lacing straps. The first set of the lacing straps may be closer to the sole structure than the second set of lacing straps. In some embodiments, the first set of lacing straps may be positioned in the heel region and the midfoot region of the article of footwear, and the second set of lacing straps may be positioned in the midfoot region and the forefoot region of the article of footwear.

The outer layer may also include one or more openings that form a passage through which the lace may be guided. In particular, a portion of the lace that is threaded through the openings may be below the outer layer.

In another aspect, an article of footwear is provided that includes an upper. The upper may include an outer layer and an elastic layer. The outer layer may extend through a forefoot region, a midfoot region, and a heel region of the article of footwear, and may cover at least partially a medial side and a lateral side of the article of footwear. The outer layer may also include a plurality of apertures. The elastic layer may extend through the midfoot region and the heel region of the article of footwear, and may cover at least partially an instep region of the article of footwear. The article of footwear may further comprise a lacing system that includes a first set of lacing straps and a second set of lacing straps. The first set of lacing straps and the second set of lacing straps may extend at least partially from the apertures, and may include an upper end having a loop with a lace threaded therethrough. Further, the elastic layer may at least partially extend from the outer layer. In addition, the outer layer may include a first elasticity and the elastic layer may include a second elasticity at least three times greater than the first elasticity.

In some embodiments, the first set of lacing straps are closer to a sole structure of the article of footwear than the second set of lacing straps. In addition, the upper may comprise an intermediate layer below the outer layer. A space may be provided between the outer layer and the intermediate layer. As such, the first set of lacing straps and the second set of lacing straps may be connected to the sole structure and may partially extend through the space.

In particular embodiments, the outer layer is a first knitted structure and the elastic layer is a second knitted structure, and the outer layer and the elastic layer may be connected at least partially at a seam. The elastic layer may also have a unitary knit construction that extends from the instep region that is proximate to the forefoot region, rearwards to a back end of the heel region, and upwards to form an opening into the article of footwear.

Other aspects of the article of footwear, including features and advantages thereof, will become apparent to one of ordinary skill in the art upon examination of the figures and detailed description herein. Therefore, all such aspects of the article of footwear are intended to be included in the detailed description and this summary.

DETAILED DESCRIPTION OF THE DRAWINGS

The following discussion and accompanying figures disclose various embodiments or configurations of a shoe and a sole structure. Although embodiments of a shoe or sole structure are disclosed with reference to a sports shoe, such as a running shoe, tennis shoe, basketball shoe, etc., concepts associated with embodiments of the shoe or the sole structure may be applied to a wide range of footwear and footwear styles, including cross-training shoes, football shoes, golf shoes, hiking shoes, hiking boots, ski and snowboard boots, soccer shoes and cleats, walking shoes, and track cleats, for example. Concepts of the shoe or the sole structure may also be applied to articles of footwear that are considered non-athletic, including dress shoes, sandals, loafers, slippers, and heels. In addition to footwear, particular concepts described herein may also be applied and incorporated in other types of apparel or other athletic equipment, including helmets, padding or protective pads, shin guards, and gloves. Even further, particular concepts described herein may be incorporated in cushions, backpack straps, golf clubs, or other consumer or industrial products. Accordingly, concepts described herein may be utilized in a variety of products.

The term "about," as used herein, refers to variation in the numerical quantity that may occur, for example, through typical measuring and manufacturing procedures used for articles of footwear or other articles of manufacture that may include embodiments of the invention disclosed herein; through inadvertent error in these procedures; through differences in the manufacture, source, or purity of the ingredients used to make the compositions or mixtures or carry out the methods; and the like. In one embodiment, the term "about" refers to a range of values±5% of a specified value.

The term "weight percent," "wt-%," "percent by weight," "% by weight," and variations thereof, as used herein, refer to the concentration of a substance or component as the weight of that substance or component divided by the total weight, for example, of the composition or of a particular component of the composition, and multiplied by 100. It is understood that, as used herein, "percent," "%," and the like may be synonymous with "weight percent," "wt-%."

Figure 1:
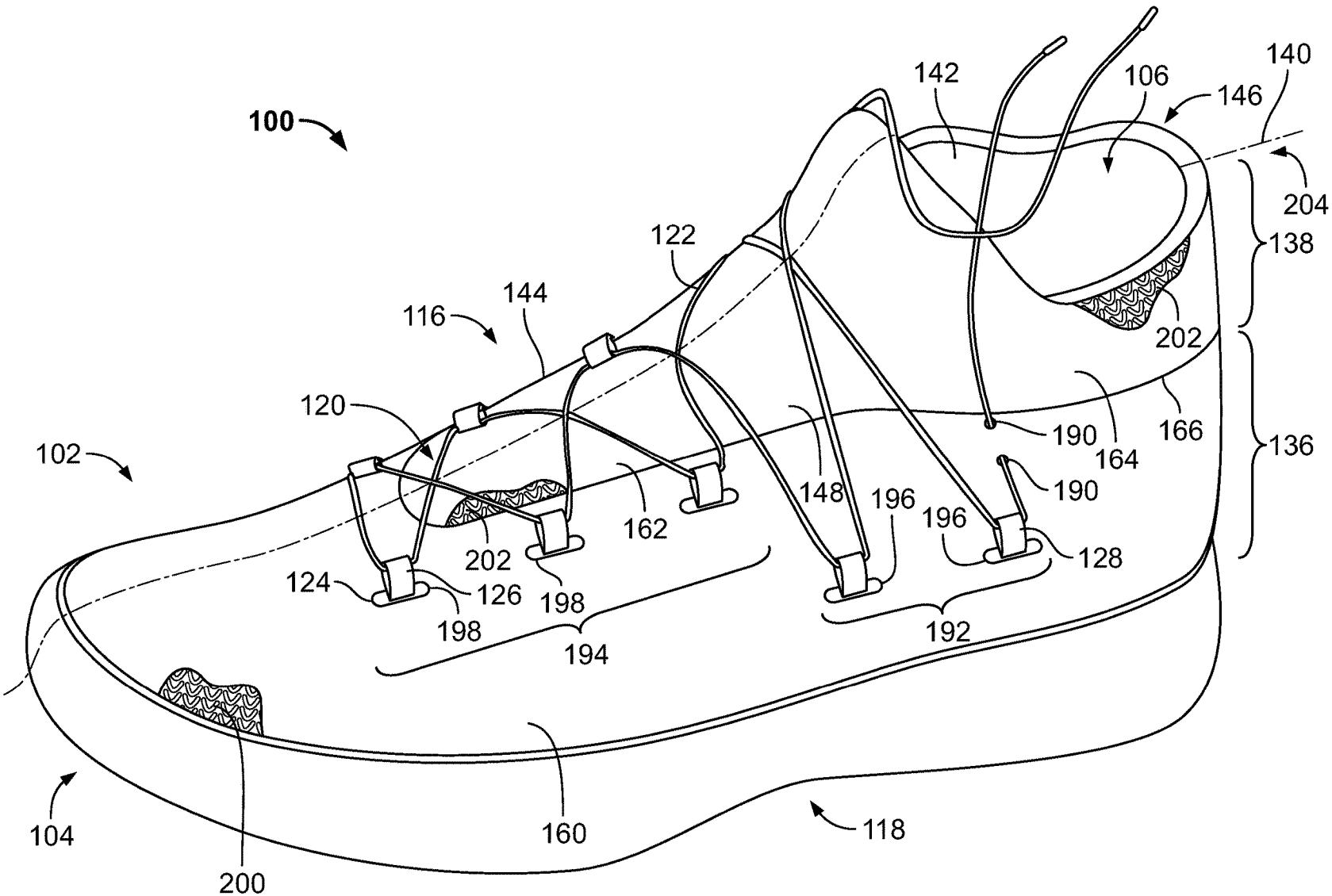
FIG. 1 is a top, front, and right perspective view of an article of footwear according to a first embodiment and including a sole structure, an upper, and a lacing system.
Figure 2:
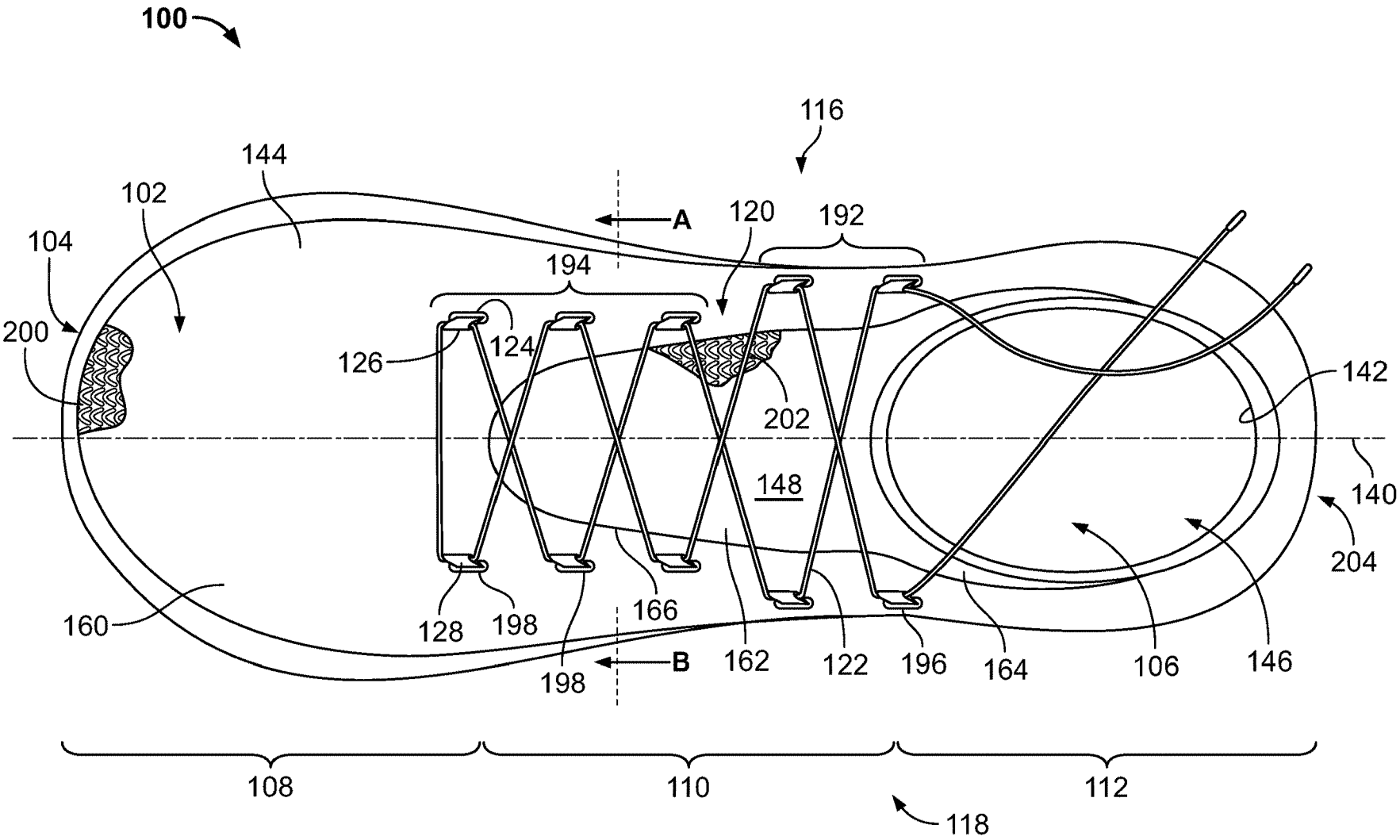
FIG. 2 is a top plan view of the article of footwear of FIG. 1.

FIGS. 1 and 2 depict an exemplary embodiment of an article of footwear 100 including an upper 102 and a sole structure 104. As will be further discussed herein, the upper 102 is attached to the sole structure 104 to provide an interior space 106 into which a foot may be placed. For reference purposes, the article of footwear 100 may be categorized by a forefoot region 108, a midfoot region 110, and a heel region 112 (see FIG. 2). The forefoot region 108 generally corresponds with portions of the article of footwear 100 that encase portions of the foot that include the toes, the ball of the foot, and joints connecting the metatarsals with the toes or phalanges. The midfoot region 110 is proximate the forefoot region 108 and generally corresponds with portions of the article of footwear 100 that encase the arch of a foot, along with the bridge of a foot. The heel region 112 is proximate the midfoot region 110 and generally corresponds with portions of the article of footwear 100 that encase rear portions of the foot, including the heel or calcaneus bone, the ankle, and/or the Achilles tendon.

The article of footwear 100 may also include a medial side 116 and a lateral side 118. In particular, the lateral side 118 corresponds to an outside portion of the article of footwear 100 and the medial side 116 corresponds to an inside portion of the article of footwear 100.

The forefoot region 108, the midfoot region 110, the heel region 112, the medial side 116, and the lateral side 118 are not intended to define precise or exact boundaries or areas of the article of footwear 100. Rather, the forefoot region 108, the midfoot region 110, the heel region 112, the medial side 116, and the lateral side 118 generally characterize sections of the article of footwear 100 to aid in discussion of the article of footwear 100. Further, both the upper 102 and the sole structure 104 may be characterized as each having portions within the forefoot region 108, the midfoot region 110, the heel region 112, and on the medial side 116 and the lateral side 118. Therefore, the upper 102 and the sole structure 104, and/or individual portions of the upper 102 and the sole structure 104, may include parts thereof within the forefoot region 108, the midfoot region 110, the heel region 112, and on the medial side 116 and the lateral side 118.

The article of footwear 100 may also have a lacing system 120 including a lace 122, a plurality of apertures 124, and a plurality of bands or lacing straps 126. In the particular embodiment shown in FIGS. 1 and 2, the lacing straps 126 extend from the apertures 124 and the lace 122 extends through loops or eyelets 128 of the lacing straps 126. Further, in some embodiments, the lacing straps 126 may be elastic bands. As will be discussed in further detail herein, the lacing system 120 may allow a user to modify dimensions of the upper 102, e.g., tighten or loosen portions of the upper 102, around a foot as desired by the wearer. As will also be discussed in further detail herein, the lacing system 120 may allow a user to modify portions of the sole structure 104, as desired by the user. The lacing system 120 may also include a band (not shown) that runs along a center of the upper 102 and includes one or more loops through which the lace 122 may be guided.

Still referencing FIGS. 1 and 2, the sole structure 104 is connected or secured to the upper 102 and extends between a foot of a user and the ground when the article of footwear 100 is worn. The sole structure 104 may include one or more components, which may include an outsole, a midsole, a heel, a vamp, and/or an insole. For example, in some embodiments, a sole structure may include an outsole that provides structural integrity to the sole structure, along with providing traction for a user, a midsole that provides a cushioning system, and an insole that provides support for an arch of a user. As will be further discussed herein, the sole structure 104 of the present embodiment of the invention includes one or more components that provide the sole structure 104 with ideal spring and damping properties.

Figure 3:
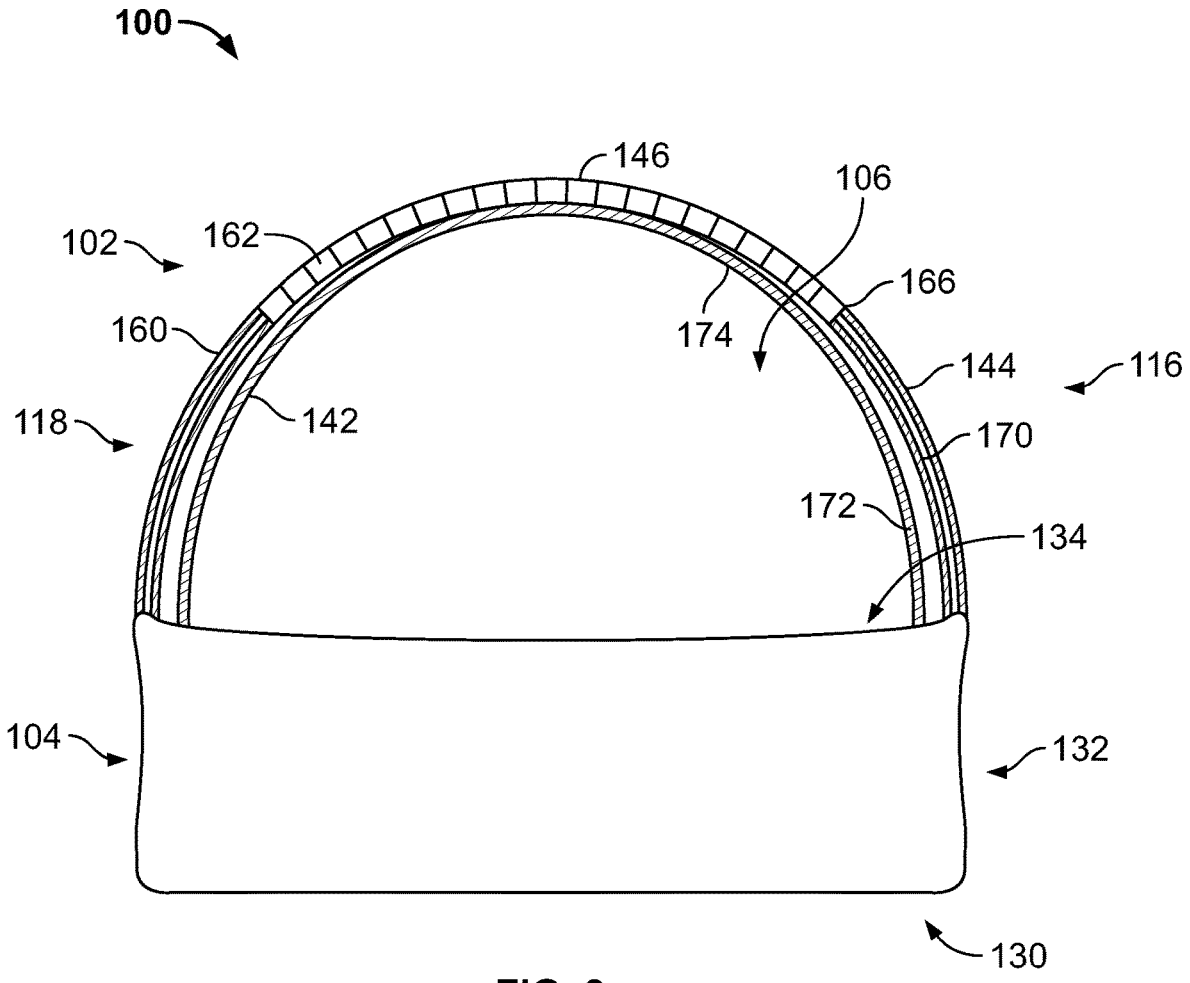
FIG. 3 is a cross-sectional view taken along lines A-B of FIG. 2, with the lacing system removed therefrom.

For reference purposes, the sole structure 104 of the present embodiment may be characterized by an outsole region 130, a midsole region 132, and an insole region 134 (see FIG. 3). The outsole region 130, the midsole region 132, and the insole region 134, and/or any components thereof, may include portions within the forefoot region 108, the midfoot region 110, and/or the heel region 112. Further, the outsole region 130, the midsole region 132, and the insole region 134, and/or any components thereof, may include portions on the lateral side 118 and/or the medial side 116.

The outsole region 130, the midsole region 132, and the insole region 134 are not intended to define precise or exact areas of the sole structure 104. Rather, the outsole region 130, the midsole region 132, and the insole region 134 are generally defined herein to aid in discussion of the sole structure 104 and components thereof.

The upper 102, as shown in FIGS. 1-3, extends upwardly from the sole structure 104 and defines the interior space 106 that receives and secures a foot of a user. The upper 102, for reference purposes, may be defined by a foot region 136 and an ankle region 138, as shown in FIG. 1. In general, the foot region 136 extends upwardly from the sole structure 104 and through the forefoot region 108, the midfoot region 110, and the heel region 112. The ankle region 138 is primarily located in the heel region 112; however, in some embodiments, the ankle region 138 may partially extend into the midfoot region 110.

With continued reference to FIGS. 1-3, the upper 102 may extend along the lateral side 118 and the medial side 116, and may extend across the forefoot region 108, the midfoot region 110, and the heel region 112 to house and enclose a foot of a user. The upper 102 may also include an apex 140 (depicted using a dashed line in FIGS. 1 and 2), which may define the boundaries of the lateral side 118 and the medial side 116 of the upper 102, i.e., the lateral side 118 of the upper 102 may be the outside portion of the upper 102 that extends from the apex 140 and the medial side 116 of the upper 102 may be the inside portion of the upper 102 that extends from the apex 140. In this particular embodiment, the upper 102 also includes an interior surface 142 and an exterior surface 144. The interior surface 142 faces inward and generally defines the interior space 106, and the exterior surface 144 of the upper 102 faces outward and generally defines an outer perimeter of the upper 102. The upper 102 also includes an opening 146 that is at least partially located in the heel region 112 of the article of footwear 100, that provides access to the interior space 106 and through which a foot may be inserted and removed. In some embodiments, the upper 102 may also include an instep area 148 that extends from the opening 146 in the heel region 112 over an area corresponding to an instep of a foot to an area adjacent the forefoot region 108.

In the embodiment shown in FIGS. 1-3, the exterior surface 144 may comprise an outer layer 160, an instep layer 162, and a collar layer 164. More particularly, the outer layer 160 extends upwardly from the sole structure 104 along the forefoot region 108, the midfoot region 110, and the heel region 112 to a boundary 166. In this embodiment, the boundary 166 defines a transition point, at which point, the upper 102 transitions from the outer layer 160 to the instep layer 162 and/or the upper 102 transitions from the outer layer 160 to the collar layer 164. More particularly, the boundary 166 defines a portion of the upper 102 where the instep layer 162 begins to extend upward from the outer layer 160, or defines a portion of the upper 102 where the collar layer 164 begins to extend upward from the outer layer 160. In some embodiments, the instep layer 162 and the collar layer 164 may be both generally referred to as a second layer 162, 164.

The boundary 166 may extend around a periphery of the upper 102; through each of the forefoot region 108, the midfoot region 110, and the heel region 112; and across the medial side 116 and the lateral side 118 of the article of footwear 100. Therefore, portions of the instep layer 162 may be within the forefoot region 108, the midfoot region 110, and the heel region 112, and along the medial side 116 and/or the lateral side 118. Further, portions of the collar layer 164 may be within the heel region 112 and/or partially within the midfoot region 110. In the particular embodiment shown in FIGS. 1-3, the instep layer 162 extends through the midfoot region 110, and the collar layer 164 is located in the ankle region 138 of the heel region 112. In other embodiments, the instep layer 162 may extend at least partially into and through the forefoot region 108, and/or at least partially into and through the heel region 112. Further, in some embodiments, the collar layer 164 may extend at least partially into the midfoot region 110.

In some embodiments, the boundary 166 may define a portion of the upper 102 where the properties associated with the instep layer 162 and/or the collar layer 164, e.g., a stitch type, a yarn type, or characteristics associated with different stitch types or yarn types, such as elasticity, aesthetic appearance, thickness, air permeability, or scuff-resistance, may be varied from the outer layer 160 or other portions of the upper 102. The boundary 166 may be provided as a seam in the present embodiment, which connects the outer layer 160 to the instep layer 162 and/or the collar layer 164. In other embodiments, the layers of the upper 102 may be interconnected at the boundary 166 using other methods known in the art.

In this particular embodiment, the outer layer 160 is a uniform structure that continuously circumscribes an entire upper perimeter of the sole structure 104. However, in other embodiments, the outer layer 160 may include a plurality of sections, such as a forefoot outer layer, a midfoot outer layer, and/or a heel outer layer that may be connected to form the outer layer 160. For example, in these embodiments, the forefoot outer layer, the midfoot outer layer, and the heel outer layer may be connected by one or more seams to form the outer layer 160.

Figure 4:
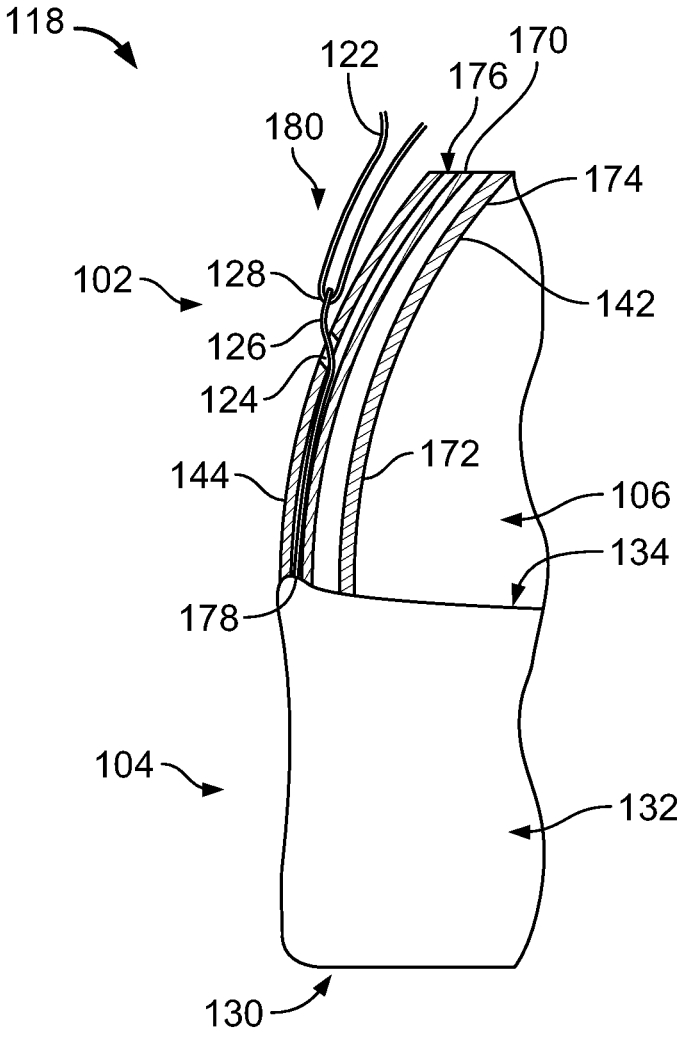
FIG. 4 is an enlarged view of a left side of the sectional view of FIG. 3, with the lacing system shown.

As best shown in FIGS. 3 and 4, the upper 102 may also include an intermediate layer 170 and an inner layer 172. In the present embodiment, an inner surface 174 of the inner layer 172 is the interior surface 142 that defines the interior space 106, and the intermediate layer 170 is positioned between the outer layer 160 and the inner layer 172. The inner layer 172 extends from the sole structure 104 on both the lateral side 118 and the medial side 116 to the apex 140 or the instep area 148. In this embodiment, the inner layer 172 is not connected to the intermediate layer 170 or the outer layer 160. Rather, the inner layer 172 is connected to the instep layer 162 at the apex 140, or at a location proximate the apex 140, of the upper 102. The inner layer 172 may be a variety of materials and, in particular embodiments, is a soft woven fabric or textile material.

Still referencing FIGS. 3 and 4, the intermediate layer 170 is enclosed by the inner layer 172 and the outer layer 160. More particularly, the intermediate layer 170 is parallel (or generally conforms) to the outer layer 160 and extends from the insole region 134 of the sole structure 104, on the lateral side 118 and the medial side 116 of the article of footwear 100, to the instep layer 162, where it is connected. With this construction, a gap or space 176 is formed between the outer layer 160 and the intermediate layer 170 (see FIG. 4).

Turning to FIG. 4, a lacing strap 126 of the lacing system 120 is shown. In this embodiment, the lacing strap 126 includes a portion between the outer layer 160 and the intermediate layer 170, and extends through the space 176. A lower end 178 of the lacing strap 126 may be connected to the sole structure 104 using stitching, glue or other adhesives, or other means known in the art. From the lower end 178, the lacing strap 126 may extend upward through and out of the space 176 through the aperture 124. An upper end 180 of the lacing strap 126 is provided with one of the eyelets 128, through which the lace 122 may be threaded. Once the lace 122 is threaded through the eyelets 128, the lacing straps 126 assist with securing the upper 102 around a foot and operate in connection with the lace 122 to enhance the fit of the article of footwear 100. In some embodiments, the upper 102 may also include a plurality of openings 190 through which the lace 122 may be threaded to secure the lace 122. In these embodiments, after the lace 122 is threaded through the openings 190, a portion of the lace 122 is positioned between the openings 190 and below the outer layer 160. The openings 190 may be spaced a distance apart between about 5 mm to about 15 mm.

Moreover, when the article of footwear 100 is provided with the lacing straps 126 and the lace 122, the lacing straps 126 may assist in providing support and/or stability to a foot of a wearer. In particular embodiments discussed herein, the lacing straps 126 may be tensioned when the lace 122 is tightened, and as a result, the lacing straps 126 resist any undesired stretching of the upper 102 as the lacing straps are secured to the sole structure 104 rather than to the upper 102.

In this particular embodiment, each lacing strap 126 may have the aforementioned characteristics. In other embodiments, the lacing system 120 may include the lacing straps 126, but may also include other lacing systems known in the art in combination with the lacing straps 126.

As best seen in FIG. 1, the upper 102 may also include on the medial side 116 and the lateral side 118 a first set of the lacing straps 192 and a second set of lacing straps 194. In these embodiments, the first set 192 may have a first set of apertures 196 and the second set 194 may have a second set of apertures 198. The first set of apertures 196 and the second set of apertures 198 may be located on the outer layer 160.

The first set of lacing straps 192 may include between one and three lacing straps on the medial side 116 and/or the lateral side 118, and the second set of lacing straps 194 may include between two and four lacing straps on the medial side 116 and/or the lateral side 118. With reference to FIGS. 1 and 2, the lacing system 120 is depicted with a first set of lacing straps 192 that includes two lacing straps on the medial side 116 and the lateral side 118, and the second set of lacing straps 194 that includes three lacing straps on the medial side 116 and the lateral side 118. In other embodiments, the number of lacing straps included in the first set 192 and the second set 194 may be dependent on a desired fit, which may vary depending on what the article of footwear is intended for (e.g., a basketball shoe, a running shoe, a soccer cleat, etc.). In further embodiments, the number of lacing straps included in the first set 192 and the second set 194 may be dependent on the size of the article of footwear. In particular embodiments, the article of footwear 100 may include at least four lacing straps and, in a preferred embodiment, five lacing straps on the medial side 116 and/or the lateral side 118.

In this exemplary embodiment, the first set 192 are positioned in the heel region 112 and the midfoot region 110, and the second set 194 are positioned in the midfoot region 110 (proximate the first set of lacing straps 192 in the midfoot region 110) and the forefoot region 108.

In addition, the first set 192 are positioned closer to the sole structure 104 compared to the second set 194. More particularly, the first set of lacing straps 192 are located in a lower region of the lateral side 118 and a lower region of the medial side 116 of the upper 102. As such, the first set of lacing straps 192 are closer to the sole structure 104 than to the apex 140 of the upper 102. In contrast, as shown in FIG. 1, the second set of lacing straps 194 are located in an upper region of the lateral side 118 and an upper region of the medial side 116 of the upper 102, so that the second set 194 are closer to the apex 140 of the upper 102 than to the sole structure 104.

With this configuration, portions of the lace 122 that extend through the eyelets 128 of the first set of lacing straps 192 extend across a larger distance of the medial side 116 and across a larger distance of the lateral side 118 of the upper 102, which may provide further support and stability to a foot of a user. For example, the first set of lacing straps 192 may provide an article of footwear 100 with a uniform tightness throughout the upper and lower regions of the medial side 116 and the lateral side 118 of the upper 102 in the heel region 112 and the midfoot region 110.

The lacing system 120, and in particular the lace 122 in combination with the lacing straps 126, may provide support, stability, and structure to the upper 102. For instance, the lace 122 in combination with the lacing straps 126 may assist with securing the upper 102 around a foot, may limit deformation in areas of the upper 102, and may overall enhance a fit of the article of footwear 100. During use, the lacing system 120 in combination with the instep layer 162 and the collar layer 164 may work together to secure the upper 102 around a foot and provide a snug and uniform fit to a foot.

Many conventional footwear uppers are formed from multiple elements (e.g., textiles, polymer foam, polymer sheets, leather, and synthetic leather) that are joined through bonding or stitching at a seam. In some embodiments, the upper 102 of the article of footwear 100 is formed from a knitted structure and, with regard to the embodiment shown in FIGS. 1-4, a majority of the upper 102 is formed from a knitted structure or knitted components.

In various embodiments, a knitted component may incorporate various types of yarn that may provide different properties to an upper. For example, one area of the upper 102 may be formed from a first type of yarn that imparts a first set of properties, and another area of the upper 102 may be formed from a second type of yarn that imparts a second set of properties. Using this configuration, properties of the upper 102 may vary throughout the upper 102 by selecting specific yarns for different areas of the upper 102.

The specific properties that a particular type of yarn will impart to an area of a knitted component may partially depend on the materials that form the various filaments and fibers of the yarn. For example, cotton may provide a soft effect, biodegradability, or a natural aesthetic to a knitted material. Elastane and stretch polyester may each provide a knitted component with a desired elasticity and recovery. Rayon may provide a high luster and moisture absorbent material, wool may provide a material with an increased moisture absorbance, nylon may be a durable material that is abrasion-resistant, and polyester may provide a hydrophobic, durable material.

Other aspects of a knitted component may also be varied to affect the properties of the knitted component and provide desired attributes. For example, a yarn forming a knitted component may include monofilament yarn or multifilament yarn, or the yarn may include filaments that are each formed of two or more different materials. In addition, a knitted component may be formed using a particular knitting process to impart an area of a knitted component with particular properties. Accordingly, both the materials forming the yarn and other aspects of the yarn may be selected to impart a variety of properties to particular areas of the upper 102.

With reference to FIGS. 1 and 2, the outer layer 160 of this embodiment is formed from a knit structure 200 and the instep layer 162 is formed from an elastic structure 202, and the knit structure 200 and the elastic structure 202 may be joined together at the boundary 166. In this embodiment, the collar layer 164 is also formed from the elastic structure 202 and may be joined with the knit structure 200 of the outer layer 160 at the boundary 166. More particularly, in this embodiment, the elastic structure 202 may be an elastic knit structure, and the instep layer 162 and the collar layer 164 may form a unitary knit construction composed of the elastic structure 202 that extends from the instep area 148, proximate the forefoot region 108 of the upper 102, rearwards to a back end 204 of the heel region 112, and upwards to form a circular or tubular structure that defines the opening 146. In other embodiments, the elastic structure 202 may be provided using materials other than knitted components that exhibit the desired elasticity discussed herein.

When the article of footwear 100 is worn, the collar layer 164 extends around or circumscribes an ankle of the wearer and may lay at least partially against the ankle. As will be discussed in further detail below, the collar layer 164 may have an elasticity greater than an elasticity of the outer layer 160 so that the collar layer 164 exhibits a greater ability to stretch than the outer layer 160. One advantage of having the collar layer 164 with an increased elasticity is that the elastic structure 202 may elongate or otherwise stretch as a foot is inserted into the upper 102 and withdrawn from the upper 102 through the opening 146. Another advantage of having the collar layer 164 with an increased elasticity is that the collar layer 164 may be partially stretched when worn and, as a result, may lay against an ankle of the wearer and prevent debris, e.g., sand, dirt, pebbles or rocks, from entering the article of footwear 100 through the opening 146.

Still referencing FIGS. 1 and 2, the instep layer 162 may extend from the heel region 112 and through the instep area 148 to an area proximate the forefoot region 108. When the article of footwear 100 is worn, the instep layer 162 may stretch to accommodate the entry of a foot within the upper 102 and may provide cushioning or increased elasticity to the upper 102 once the foot has been inserted into the article of footwear 100. As best seen in FIG. 2, the instep layer 162 extends between the lateral side 118 and the medial side 116 of the upper 102, and across the apex 140 of the upper 102. In this embodiment, the instep layer 162 extends from a lateral side 118 of the boundary 166 to a medial side 116 of the boundary 166 and is approximately in the middle of the upper 102.

In an exemplary embodiment, the instep layer 162 and the collar layer 164 may be formed using a knit structure that provides increased flexibility to portions of the upper 102. For example, as discussed herein, the instep layer 162 and the collar layer 164 may include the elastic structure 202 and may be surrounded by the remaining portions of the upper 102, i.e., the outer layer 160. More particularly, the elastic structure 202 may include a yarn type that provides increased flexibility, stretch resistance, or elasticity to the instep layer 162 and the collar layer 164. In a preferred embodiment, the elastic structure 202 includes a spandex yarn.

In these embodiments, the outer layer 160 may be formed from the knit structure 200, which has a different knit structure than the elastic structure 202. The knit structure 200 may be a knit structure having a reduced or smaller elasticity than the elastic structure 202 to provide support and stability to the upper 102.

In some embodiments, an elasticity of a knit structure may be measured based on comparing a width or length of the knit structure in a first, non-stretched state to a width or length of the knit structure in a second, stretched state after the knit structure has a force applied to the knit structure in a lateral direction. For example, in an unstretched condition, the elastic structure 202 may have a first width and a first thickness, and in a stretched condition, the elastic structure 202 may have a second width and a second thickness. Similarly, the knit structure 200 may have a first width and a first thickness in an unstretched condition, and may have a second width and a second thickness in a stretched condition.

In one embodiment, after a predetermined force is applied to stretch the elastic structure 202, the second width of the elastic structure 202 may be larger than the first width of the elastic structure 202. For example, a second width of the elastic structure 202 may be at least 20% larger than a first width of the elastic structure 202. In other cases, a second width of the elastic structure 202 may be between about 25% to about 50% larger than a first width of the elastic structure 202, or the second width of the elastic structure 202 may be at least 50% larger than the first width of the elastic structure 202.

Different from that of the elastic structure 202, even after a predetermined force is applied to stretch the knit structure 200, a second width of the knit structure 200 may be the same, or substantially the same, as a first width of the knit structure 200. In other embodiments, a second width of the knit structure may be larger than a first width of the knit structure 200. For example, a second width of the knit structure 200 may be between about 0% to about 25% larger than a first width of the knit structure 200, or between about 0% to about 50% larger than the first width of the knit structure 200.

In particular embodiments, the elastic structure 202 of the instep layer 162 and/or the collar layer 164 may have an elasticity between about two and five times greater than an elasticity of the outer layer 160 or other remaining portions of the upper 102. In a preferred embodiment, an elasticity of the elastic structure 202 of the instep layer 162 and/or the collar layer 164 may be at least three times greater than an elasticity of the outer layer 160 or other remaining portions of the upper 102. For example, in the aforementioned preferred embodiment, if a predetermined force is applied to the knit structure 200 so that the second, stretched width of the knit structure 200 is about 5% larger than a first, unstretched width, when the same predetermined force is applied to the elastic structure 202, a second, stretched width of the elastic structure 202 must be at least about 15% larger than a first, unstretched width of the elastic structure 202.

In further embodiments, the upper 102 may also include additional structural elements. For example, in some embodiments, a heel plate or cover (not shown) may be provided on the heel region 112 to provide added support to a heel of a user. In some instances, other elements (e.g., plastic material, logos, trademarks, etc.) may also be applied and fixed to the exterior surface 144 using glue or a thermoforming process.

Figure 5:
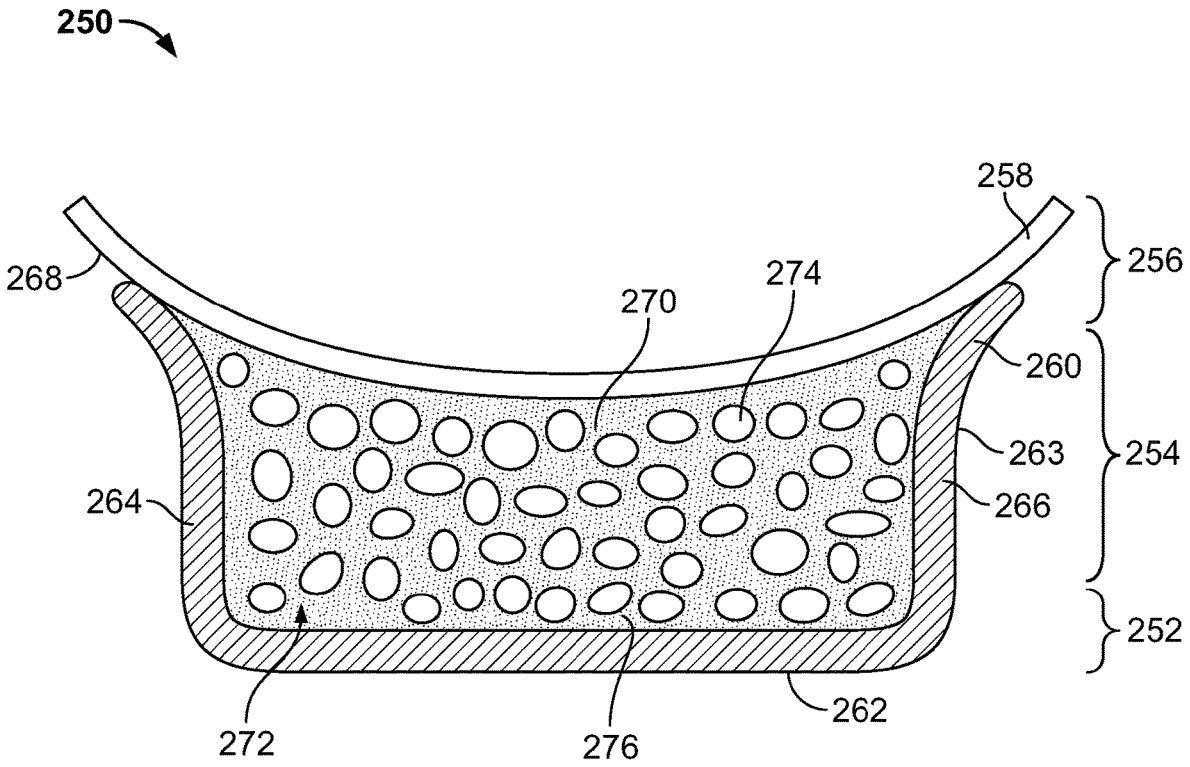
FIG. 5 is a cross-sectional view of a second embodiment of the sole structure of FIGS. 1-4.

Turning to FIG. 5, a cross-sectional view of a sole 250 is depicted, which may provide the sole structure 104 of the article of footwear 100. For reference purposes, the sole 250 of the present embodiment includes an outsole region 252, a midsole region 254, and an insole region 256. The outsole region 252, the midsole region 254, and the insole region 256, and/or any components thereof, may include portions thereof within the forefoot region 108, the midfoot region 110, and/or the heel region 112 of the article of footwear 100. Further, the outsole region 252, the midsole region 254, and the insole region 256, and/or any components thereof, may include portions thereof on the lateral side 118 and/or the medial side 116 of the article of footwear 100.

The outsole region 252, the midsole region 254, and the insole region 256 are not intended to define precise or exact areas of the sole 250. Rather, the outsole region 252, the midsole region 254, and the insole region 256 are generally defined herein to aid in discussion of the sole 250 and components thereof.

The sole 250 may include different layers throughout the outsole region 252, the midsole region 254, and/or the insole region 256. Each layer may serve a particular function. For example, the sole 250 may include a sockliner or insole 258 designed to contact a bottom of a foot and provide comfort and support to the foot. The sole 250 may also include an outsole or casing 260 that includes a bottom surface 262 and a sidewall 263 that may include a lateral side portion 264 and a medial side portion 266 that extend upward from the bottom surface 262. In this embodiment, the lateral side portion 264 and the medial side portion 266 of the sidewall 263 extend upward and connect to a bottom surface 268 of the insole 258. During normal use, the bottom surface 262 of the casing 260 contacts the ground and may provide a degree of cushioning and traction to a wearer. More particularly, the casing 260 may be formed from an abrasive-resistant material, such as rubber, to protect the sole 250 and provide the article of footwear 100 with the ability to positively grip a ground surface during use. The casing 260 also provides support and stability to the sole 250 and, in particular, support and stability to a midsole or midsole mixture 270 of the sole 250. In a preferred embodiment, the casing 260 is also a transparent or translucent material so that the midsole mixture 270 may be visible therethrough.

The casing 260 and the insole 258 may define a void or cavity 272 that includes the midsole mixture 270. As shown in FIG. 5, the midsole mixture 270 may include a plurality of plastic bodies 274 and a binder 276 that is disposed between the plastic bodies 274 and connects the plastic bodies 274 in the cavity 272. The plastic bodies 274 in combination with the binder 276 provide improved cushioning properties by absorbing impact energy created when the bottom surface 262 contacts or strikes the ground during use. The plastic bodies 274 and the binder 276 also exhibit improved spring and damping properties to the sole 250, which may be desirable for particular uses of the article of footwear 100. For example, the particular spring and damping properties exhibited by the sole 250 may be desirable for basketball shoes or running shoes. The configuration, size, and/or position of the midsole mixture 270, and/or components thereof, within the cavity 272 may vary from the particular position shown in FIG. 5 without departing from the scope of this disclosure. For example, the plastic bodies 274 may be uniformly spaced within the binder 276 and within the cavity 272 as shown in FIG. 5, or the plastic bodies 274 may be off-center or strategically positioned within the binder 276 and/or the cavity 272 to provide a desired cushioning or midsole system. In one embodiment, the sole 250 may have an increased amount of plastic bodies 274 in one of the forefoot region 108, the midfoot region 110, and the heel region 112, and/or on one of the medial side 116 and/or the lateral side 118 of the sole 250.

In some embodiments, the plastic bodies 274 may comprise between about 40 wt. % to about 95 wt. % of the midsole mixture 270, and the binder 276 may comprise between about 5% to about 60% wt. % of the midsole mixture 270. In other embodiments, the plastic bodies 274 may comprise about 50 wt. % to about 60 wt. % of the midsole mixture 270, and the binder 276 may comprise between about 40 wt. % to about 50 wt. % of the midsole mixture 270. In even further embodiments, the plastic bodies 274 may comprise about 55 wt. % to about 65 wt. % of the midsole mixture 270, and the binder 276 may comprise between about 35 wt. % to about 45 wt. % of the midsole mixture 270. In one preferred embodiment, the plastic bodies 274 comprise about 60 wt. % of the midsole mixture 270 and the binder 276 comprises about 40 wt. % of the midsole mixture. In another preferred embodiment, the plastic bodies 274 comprise about 70 wt. % of the midsole mixture 270 and the binder 276 comprises about 30 wt. % of the midsole mixture 270.

The plastic bodies 274 and the binder 276 may be formed from multiple elements or compositions, as will be discussed below. In particular embodiments, the plastic bodies 274 are formed from a thermoplastic material and, more particularly, an expanded thermoplastic foam. For example, the plastic bodies 274 may be an expanded thermoplastic urethane (E-TPU), an expanded thermoplastic elastomer (E-TPE), an expanded thermoplastic polyamide (E-TPA), an expanded thermoplastic polyolefin (E-TPO), an expanded thermoplastic polypropylene (E-PP), an expanded thermoplastic polyethylene (E-PEX), an expanded thermoplastic alloy, and/or any combination thereof.

The plastic bodies 274 may be formed from an extrusion process and may have a variety of shapes and sizes. In some embodiments, the plastic bodies 274 may be spherical or ellipsoidal having dimensions (e.g., a width, a height, and a length) that are definable. For example, the plastic bodies 274 may have a width, a height, and/or a length between about 1 mm to about 13 mm and, more particularly, between about 3 mm and about 9 mm. In the embodiments that the plastic bodies 274 are spherical, the plastic bodies 274 may have dimensions between about 1 mm to about 13 mm and, more particularly, between about 3 mm and about 9 mm in all three spatial directions. In a preferred embodiment, the plastic bodies 274 may have a size with dimensions ranging from about 5 mm to about 8 mm.

Different materials may form the binder 276. In the present embodiment, the binder 276 may bond to the plastic bodies 274 to create the midsole mixture 270, and as a result, the material used for the binder 276 may be dependent on the material used for the plastic bodies 274 to insure an ideal bond or connection. For example, when the plastic bodies 274 are an expanded thermoplastic urethane, the binder 276 may be a polyester, a polyurethane, and/or a polyester polyurethane. In a preferred embodiment, the binder 276 may be a polyurethane, such as a 1K polyester polyurethane, a 1K polyether polyurethane, a 2K polyester polyurethane, or a 2K polyether polyurethane. The binder 276 may also be a solid material or may be a foam material, and may have a density ranging between about 0.01 g/cm$^3$ to about 0.5 g/cm$^3$.

In one embodiment, the sole 250 may be formed by first mixing one or more plastic bodies 274 with one or more binders 276 to produce the midsole mixture 270. Next, the midsole mixture 270 may be poured directly into the cavity 272 of the casing 260 and allowed to co-mold as one.

Any of the embodiments described herein may be modified to include any of the structures or methodologies disclosed in connection with different embodiments. Further, the present disclosure is not limited to articles of footwear of the type specifically shown. Still further, aspects of the articles of footwear of any of the embodiments disclosed herein may be modified to work with any type of footwear, apparel, or other athletic equipment.

EXAMPLES

The examples are intended to illustrate certain embodiments of compositions to be used in the sole 250 and/or sole structure 104 to one of ordinary skill in the art and should not be interpreted as limiting in scope of the disclosure set forth in the claims. The composition of the sole 250 and/or the sole structure 104 may comprise the following non-limiting examples.

Example 1

Table 1 lists several physical properties of exemplary embodiments of the midsole mixture 270. In these embodiments, the plastic bodies 274 of the midsole mixture 270 are an expanded thermoplastic copolyester elastomer (E-TPC), and the binder 276 is one of a polyester polyurethane foam or a polyether polyurethane foam. In this example, the plastic bodies 274 comprise about 60 wt. % of the midsole mixture 270 and the binder 276 comprises about 40 wt. % of the midsole mixture 270.

TABLE 1

| | Midsole Mixture | |
|---|---|---|
| Physical properties | Polyester PU Foam | Polyether PU Foam |
| Density (kg/m$^3$) | 277 | 249 |
| Hardness (AskC) | 45 | 43 |
| Pendulum rebound (%) | 62 | 60 |
| Tensile Strength (MPa) | 2.3 | 2.0 |
| Elongation (%) | 85 | 92 |
| Trouser Tear (N/mm) | 8.5 | 5.9 |
| Slit Tear (N/mm) | 4.5 | 4.23 |

Example 2

Table 2 lists several physical properties of exemplary embodiments of the midsole mixture 270 having varying weight percentages of the plastic bodies 274 and the binder 276. In these embodiments, the plastic bodies 274 of the midsole mixture 270 are an expanded thermoplastic copolyester elastomer (E-TPC), and the binder 276 is a polyurethane foam, such as a polyester polyurethane foam or a polyether polyurethane foam.

TABLE 2

| | Midsole Mixture | |
|---|---|---|
| Physical properties | 50 wt. % E-TPC<br>50 wt. % PU foam | 60 wt. % E-TPC<br>40 wt. % PU foam |
| Density (kg/m$^3$) | 275 | 260 |
| Hardness (AskC) | 47 | 52 |
| Pendulum rebound (%) | 60 | 62 |
| Tensile Strength (MPa) | 1.3 | 1.3 |
| Elongation (%) | 66 | 69 |
| Trouser Tear (N/mm) | 6.5 | 7.3 |

As noted previously, it will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. An article of footwear comprising:

a sole structure; and an upper, the upper including:

an outer layer extending continuously through a forefoot region, a midfoot region, and a heel region of the article of footwear, the outer layer covering at least partially a medial side and a lateral side of the article of footwear;

an inner layer positioned below the outer layer;

an intermediate layer positioned between the inner layer and the outer layer, the intermediate layer extending continuously along the outer layer;

an elastic layer extending through the midfoot region and the heel region of the article of footwear, the elastic layer at least partially covering an instep region of the article of footwear; and a lacing system extending at least partially across the instep region and including at least one lacing strap positioned between the outer layer and the intermediate layer, wherein the outer layer includes a first elasticity and the elastic layer includes a second elasticity, the second elasticity being at least three times greater than the first elasticity, wherein the outer layer, the inner layer, and the intermediate layer each extend from the sole structure, and wherein the outer layer and the intermediate layer are coupled to the elastic layer such that a space is defined between the outer layer and the intermediate layer that extends from the sole structure to the elastic layer and along at least the medial and lateral sides of the article of footwear, the at least one lacing strap extending within the space from the sole structure toward the elastic layer.

2. The article of footwear of claim 1, wherein the outer layer is a knitted structure.

3. The article of footwear of claim 1, wherein the outer layer and the elastic layer are coupled using a seam.

4. The article of footwear of claim 3, wherein the elastic layer has a unitary knit construction that extends from a portion of the instep region that is proximate to the forefoot region, rearwards to a back end of the heel region, and upwards to form an opening into the article of footwear.

5. The article of footwear of claim 1, wherein the inner layer is positioned below the intermediate layer and the elastic layer, and includes at least a portion that extends from the lateral side of the sole structure to the medial side of the sole structure.

6. The article of footwear of claim 5, wherein the elastic layer comprises an instep layer and a collar layer, and wherein the instep layer extends at least partially across the instep region and the collar layer extends at least partially from the instep region to the heel region.

7. The article of footwear of claim 5, wherein the inner layer is directly connected only to the elastic layer and the sole structure.

8. The article of footwear of claim 1, wherein the lacing system further comprises:

at least one aperture in the outer layer opening into the space; and a lace, wherein a lower end of the at least one lacing strap is connected to the sole structure and an upper end of the at least one lacing strap defines a loop that at least partially extends outwardly from the space through the at least one aperture, and wherein the lace is threaded through the loop.

9. The article of footwear of claim 8, wherein the lacing system further comprises:

at least four lacing straps on the medial side; and at least four lacing straps on the lateral side.

10. The article of footwear of claim 9, wherein the lacing system further comprises:

a first set of lacing straps; and a second set of lacing straps, wherein loops of the first set of lacing straps are disposed closer to the sole structure than loops of the second set of lacing straps.

11. The article of footwear of claim 8, the outer layer further comprising:

at least two openings, wherein the openings form a passage through which the lace is guided, and wherein a portion of the lace that is threaded through the openings is below the outer layer.

12. The article of footwear of claim 10, wherein the first set of lacing straps are positioned in the heel region and the midfoot region of the article of footwear, and the second set of lacing straps are positioned in the midfoot region and the forefoot region of the article of footwear.

13. The article of footwear of claim 10, wherein the first set of lacing straps includes at least one strap of the at least four lacing straps on the medial side and at least one strap of the at least four lacing straps on the lateral side.

14. The article of footwear of claim 1, wherein the inner layer is an interior surface of the article of footwear that defines an interior space thereof.

15. An article of footwear having an upper, the upper comprising:

an outer layer extending through a forefoot region, a midfoot region, and a heel region of the article of footwear, the outer layer covering at least partially a medial side and a lateral side of the article of footwear and having a plurality of apertures;

an intermediate layer extending parallel to the outer layer;

an elastic layer extending through the midfoot region and the heel region, the elastic layer at least partially covering an instep region of the article of footwear; and a lacing system including a lace, a first set of lacing straps, and a second set of lacing straps, wherein each lacing strap of the first and second sets of lacing straps has an upper end defining a loop that at least partially extends from the apertures to receive a portion of the lace therethrough, wherein the loops of the first set of lacing straps are arranged closer to a sole structure of the article of footwear than the loops of the second set of lacing straps, and the first set of lacing straps are arranged closer to a back end of the heel region than the second set of lacing straps, wherein the elastic layer at least partially extends from the outer layer and the intermediate layer, such that the outer layer and the intermediate layer are each directly connected to the elastic layer, wherein the intermediate layer is not directly connected to the outer layer along at least portions of the medial side and the lateral side such that a space is defined between the outer layer and the intermediate layer that extends from the sole structure to the elastic layer and along at least portions of the medial and lateral sides with a lower end of each lacing strap of the first and second sets of lacing straps being disposed therein, and wherein the outer layer includes a first elasticity and the elastic layer includes a second elasticity, the second elasticity being at least three times greater than the first elasticity.

16. The article of footwear of claim 15, wherein the outer layer and the elastic layer at least partially define an exterior surface of the upper, and wherein the intermediate layer extends below the outer layer, opposite the exterior surface.

17. The article of footwear of claim 16, wherein the outer layer is a first knitted structure and the elastic layer is a second knitted structure, and wherein the outer layer and the elastic layer are connected at least partially at a seam formed on the exterior surface.

18. The article of footwear of claim 17, wherein the seam extends continuously around a periphery of the upper.

19. The article of footwear of claim 17, wherein the elastic layer has a unitary knit construction that extends from the instep region that is proximate to the forefoot region, rearwards to the back end of the heel region, and upwards to form an opening into the article of footwear.

20. The article of footwear of claim 15, wherein a portion of the lacing straps are covered by the outer layer.

* * * * *